US008109710B2

(12) United States Patent
Bengtsson

(10) Patent No.: US 8,109,710 B2
(45) Date of Patent: Feb. 7, 2012

(54) METHOD AND A DEVICE FOR SEPARATING OF MAGNETIC AND NON-MAGNETIC BLANKS PLACED IN A STACK

(76) Inventor: Brodde Bengtsson, Jämshög (SE)

( * ) Notice: Subject to any disclaimer, the term of this patent is extended or adjusted under 35 U.S.C. 154(b) by 392 days.

(21) Appl. No.: 12/442,797

(22) PCT Filed: Sep. 24, 2007

(86) PCT No.: PCT/SE2007/000838

§ 371 (c)(1),
(2), (4) Date: Mar. 25, 2009

(87) PCT Pub. No.: WO2008/039129

PCT Pub. Date: Apr. 3, 2008

(65) Prior Publication Data

US 2010/0078876 A1 Apr. 1, 2010

(30) Foreign Application Priority Data

Sep. 27, 2006 (SE) ..... 0602004

(51) Int. Cl.
*B65H 3/00* (2006.01)
*B65H 3/24* (2006.01)
*B65H 1/08* (2006.01)

(52) U.S. Cl. ..... 414/796.6; 414/795.4; 414/796.9; 271/42; 271/129

(58) Field of Classification Search ..... 221/213–215, 221/223, 238, 262, 268, 274, 292; 271/10.16, 271/33, 4.11, 42, 901, 128–129; 294/61; 414/795.4–795.5, 796.5, 796.6, 796.8, 796.9, 414/797.3, 797.7–797.9, 798.6; 451/334, 451/335; 74/110, 96
See application file for complete search history.

(56) References Cited

U.S. PATENT DOCUMENTS 282,014 A * 7/1883 Stuart ..... 271/113
(Continued)

FOREIGN PATENT DOCUMENTS

JP 61027847 2/1986

OTHER PUBLICATIONS

International Search Report dated Dec. 20, 2007, issued in corresponding international application No. PCT/SE2007/000838.

*Primary Examiner* — Gregory Adams
(74) *Attorney, Agent, or Firm* — Ostrolenk Faber LLP

(57) ABSTRACT

The invention relates to a method and a device to separate blanks form each other in a stack by that at least one separating unit is brought into contact with one or more of the edges of the blank stack. The separating unit comprises a separating arm having a narrow teeth provided blade, which moves first horizontally until a tooth grasps the uppermost blank, whereupon the arm having the narrow teeth provided blade controllably moves upwards and lifts one blank edge. An air knife, which acts towards the side of the blank stack in a direct connection to the point of application of the teeth provided blade, can give one or several air thrusts when the blade is starting its controlled movement upwards and is urging like an wedge in under a slit under the uppermost blank of the blank stack, an eventual existing vacuum between the blanks being disappeared at the same time as the uppermost blank of the blank stack receives a lifting force by the air cushion, created.

12 Claims, 10 Drawing Sheets

U.S. PATENT DOCUMENTS

| | | | | | |
|---|---|---|---|---|---|
| 720,547 | A | * | 2/1903 | Fuchs et al. | 271/128 |
| 1,121,556 | A | * | 12/1914 | Halvorsen | 221/213 |
| 1,352,308 | A | * | 9/1920 | Murray | 271/128 |
| 3,669,445 | A | | 6/1972 | Wallis | |
| 3,697,303 | A | | 10/1972 | Kramer et al. | |
| 4,079,846 | A | * | 3/1978 | Tsuruta | 414/796.6 |
| 4,405,276 | A | * | 9/1983 | Wiegand | 414/796.8 |
| 4,453,873 | A | * | 6/1984 | Curti | 414/796.9 |
| 4,465,415 | A | | 8/1984 | Eberling et al. | |
| 4,865,178 | A | * | 9/1989 | Lewandowski | 194/227 |
| 5,462,374 | A | * | 10/1995 | Kohno | 400/625 |
| 5,722,811 | A | * | 3/1998 | Schum et al. | 414/796 |
| 7,226,271 | B1 | * | 6/2007 | Fullenkamp et al. | 414/796.8 |
| 7,427,003 | B1 | * | 9/2008 | Peterson | 221/274 |

* cited by examiner

METHOD AND A DEVICE FOR SEPARATING OF MAGNETIC AND NON-MAGNETIC BLANKS PLACED IN A STACK

CROSS REFERENCE TO RELATED APPLICATIONS

The present application is a 35 U.S.C. §371 National Phase conversion of PCT/SE2007/000838, filed Sep. 24, 2007, which claims benefit of Swedish Application No. 0602004-4, filed Sep. 27, 2006, the disclosure of which is incorporated herein by reference. The PCT International Application was published in the English language.

BACKGROUND OF THE INVENTION

The present invention refers to a method and a device for separating magnetic and non-magnetic mainly plane sheet- or disc-shaped blanks piece by piece, such as plates of steel and aluminum, which constitute a stack and other plane blanks e.g. sheets of plastic and so on, which are piled up in similar stacks and which usually are placed on a pallet or rack. The invention comprises a movement means in order to separate piece by piece and lift up one or more edges of these blanks by aid of a separating unit, which is gripping the edge of the uppermost blank and when needed the movement means is also feeding in an air beam between the actual blanks in order to eliminate vacuum between the same, which speeding up the separation by giving the uppermost blank a lifting force of that air cushion, which in this case is achieved between the blanks. When the separated blank has been lifted away from this collecting position, usually by aid of suction cups, the next blank is separated and so on piece by piece in a continuous process until the stack of blanks in principle is emptied.

By automation of presses separate blanks are often fetched from a stack of blanks where separate blanks are stacked directly one upon the other on a pallet. Said pallet is often larger than the stack and usually provided with locating pins, which guarantees that the position of the stack on said pallet and which also prevent the blanks to slip during transport. When taking out a blank for further processing in a press some kind of feeding means is used, usually suction pillows or the like. When the blanks have been separated piece by piece they are one by one transported to a centering means, where they are carefully determined of position and from where they thereafter are fed into the press. Provided that the position of the stack is carefully known the blanks can eventually be fed directly into the press. During later years owing to increased environment demands and higher energy prices the development has been moved forwards resulting in that new and lighter materials to an ever increasing extent are used within the vehicle industry and this has led to that more aluminum materials and plastic materials, i.e. non-magnetic materials have started to be used and this is expected to increase strongly in the near future. At the same time as also the material prices are increased strongly, you have, in order to put a stop to the material cost during later years, increased the use of formed cut blanks, so that one obtains more blanks from one blank area, which saves material and lowers the material cost. This means that a separation piece by piece of non magnetic blanks having strongly angles and curve formations are desirable, something which the technology of today does not manages by aid of fanner magnets, compressed air or wide screwed formed arrangements. Separating magnets can only be used on magnetic materials and cannot be used on non-magnetic materials or blanks. Only compressed air cannot separate between upper or under lying blanks, but penetrate into where it already exist a small slit between the blanks, independent of what blank it is in order and can also nevertheless create a separation of two, three or more blanks at the same time. There is nothing which control that the separation occurs with only one blank at the time.

Wide screw formed arrangements require large planar and parallel opposite areas and therefore can only tolerably be used on quadratic and rectangular blanks and are already of this reason useless on formation cut blanks. These arrangements are also space requiring when the screws drive the blanks laterally, so that space requiring holding up tools must be installed in order to stop this. It also required a space much below the separating level, which creates problems when the blank pallets often are larger than these blanks, which are stacked on the pallet. The pallet prevents in this way the separation of blanks in the lower portion of the stack, so that a larger number of blanks usually will not be picked up but have to leave the plant for time requiring manual actions. These screw formed arrangements consist of threads or thread similar grooves, which do not grasp the blank but the blank slips in the threads, which often create not wanted chips on the blanks, which causes quality problems of the finished product. By that fact that aluminum oxide also wears very hard on these thread groves and which requires frequent and expensive exchanges and besides causes production stops to a cost which is far too much, this method is not useable under production like forms in a modern production.

SUMMARY OF THE INVENTION

The object of the present invention is to provide a separating device, which in an excellent way fulfils its purpose at the same time as it besides is both cheap and simple to manufacture. Another object of the present invention is also to provide a method for a safe and effective separating of magnetic and non magnetic blanks of sheet e.g. aluminum piece by piece from a stack of blanks with that demand that the method is not limited to mainly quadratic and rectangular blanks having parallel opposite areas, but can also handle that during the last years increased use of form cut blanks. Besides the claim of compactness exists, so that a small space need can be met at the same time as the separating device does not have any physical portions which extend below that level on which the stack of blanks are placed upon. This gives the blank separating device further a very much valuable and unique quality i.e. it has also as one of the main purposes to be available during modifying older, existing equipments constructed only for separating magnetic and more or less quadratic blanks, so that they can manage also non magnetic form cut blanks also if that plane, which the stack of blanks is placed upon is larger than the plane of the stack of blanks, which is not allowed to be any obstacle for grasping of the blanks after said reconstruction.

Another fundamental object of the invention is to prevent that slipping starts or that the mechanical grasping of the uppermost blank looses its grasp, so that chips are formed or that small particles are loosen from the blank when it shall be separated. This is solved by this invention by an unique trigonometry, which is adjusting the grasping of the teeth in relation to that force which is needed to separate and lift the uppermost blank of the blank stack. Another object of the invention is to provide a simple and robust structure, which is the reason for that a continuous operation can be realized during long periods of time and that the costs are kept within acceptable limits.

By these features a good separating can be made by a moving means to separate piece by piece and to lift up one or more edges of blanks, which also comprise non magnetic and form cut blanks, by aid of teeth or spines and when needed the device can shoot in an air beam in order to eliminate that vacuum which can exist between the two uppermost blanks. The blank separators can also by their compact design, as mentioned above, be used during reconstruction of existing equipment, which gives considerable cost savings.

The invention will now be described closer below in detail by reference to the accompanying drawings, in which

DESCRIPTION OF PREFERRED EMBODIMENTS

Figure 1:
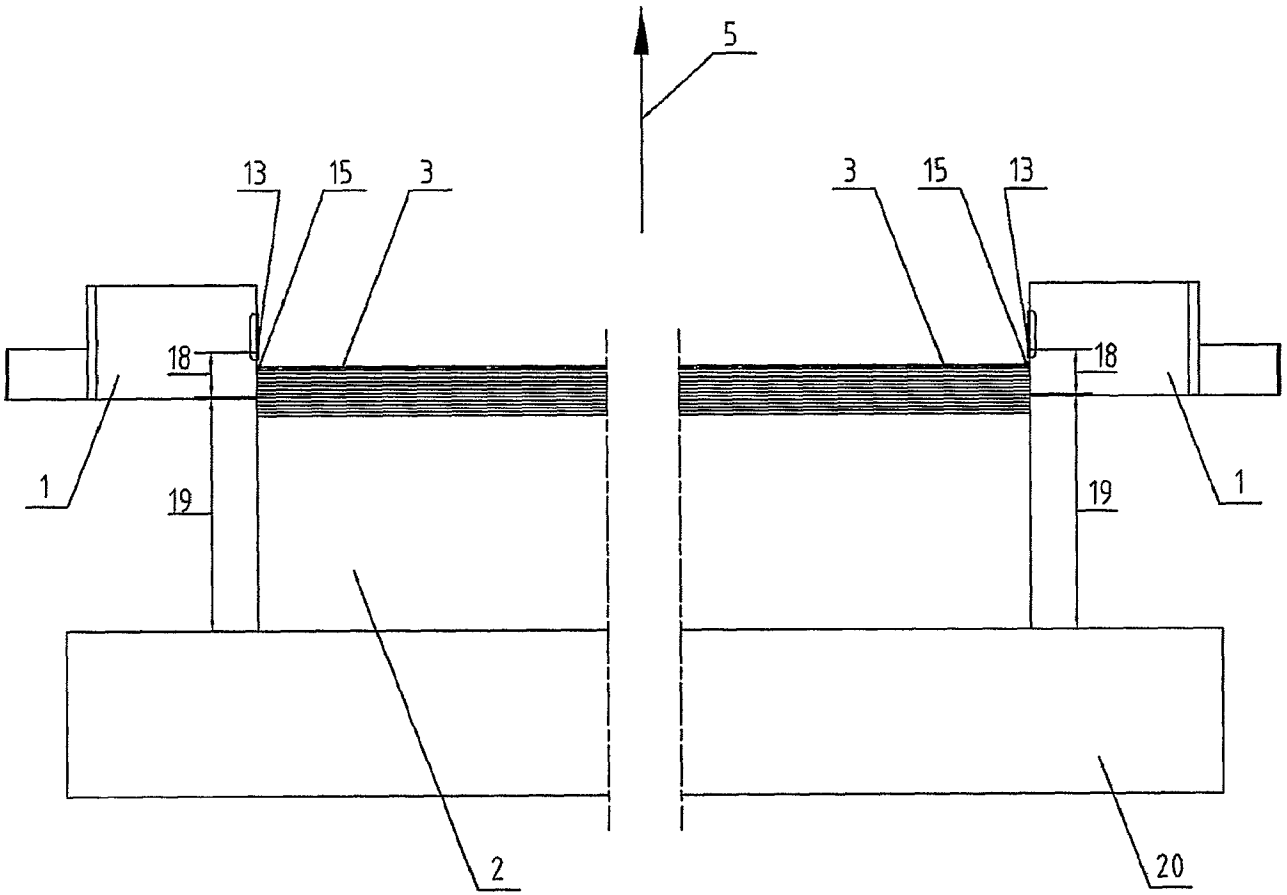
FIG. 1 shows a schematic side view of the device according to the invention.
Figure 2:
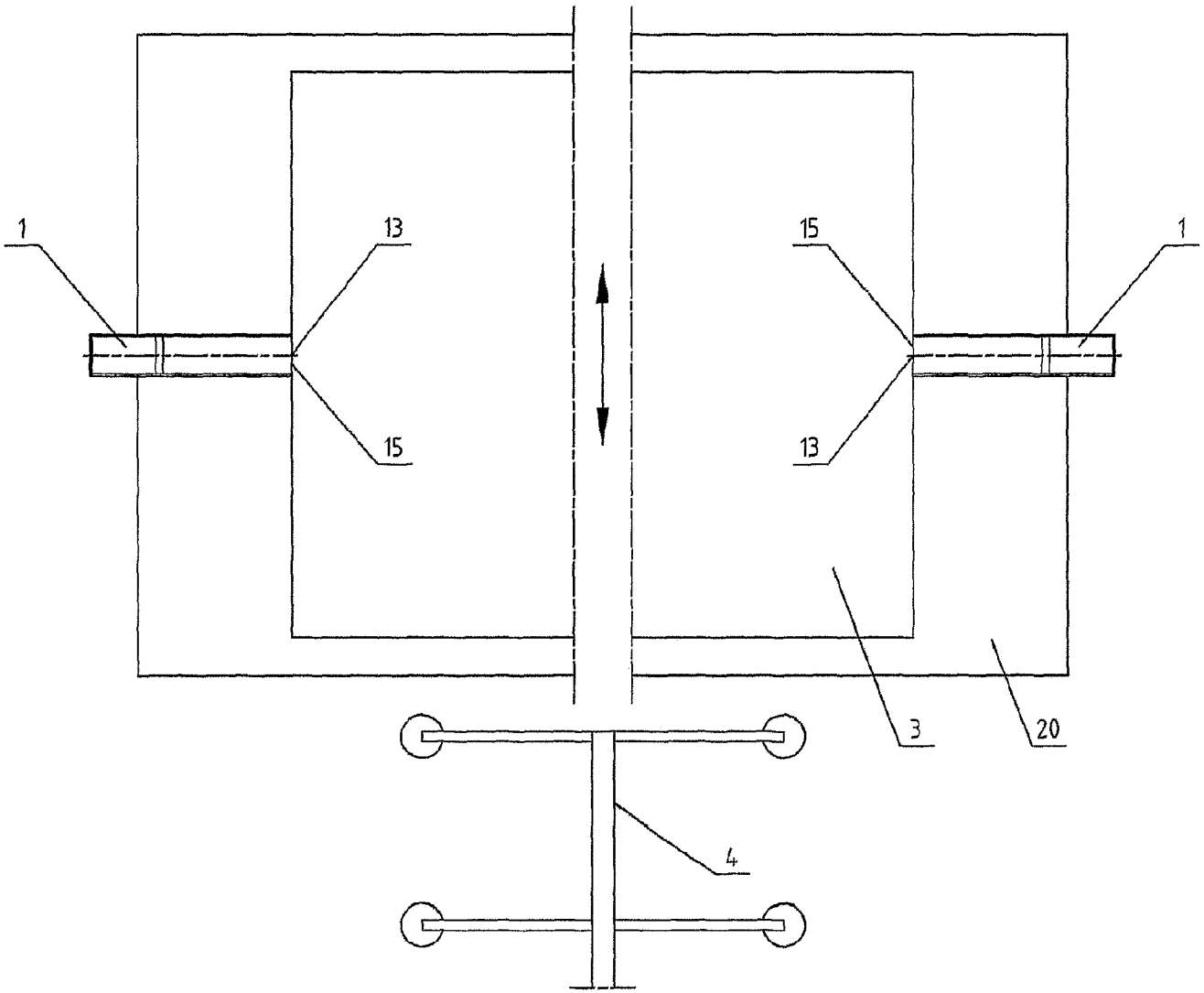
FIG. 2 shows a view from above of FIG. 1.

As can be seen from the drawings the invention consists of at least blank separator or separating unit 1 and in the illustrated example of two separating units 1, contacting against an upper edge portion of that stack 2 of blanks 3, which shall be separated from each other, so that by this adherence between the objects, caused by vacuum, oil film or by other reasons, is stopped, so that the upper most blank in the stack 2 can be caught by a picking means 4 for feeding the blanks into a following machine not illustrated in the drawings. An intended separating direction 5 is parallel to or mainly parallel to a normal to the extension plane of the blanks 3.

Figure 3:
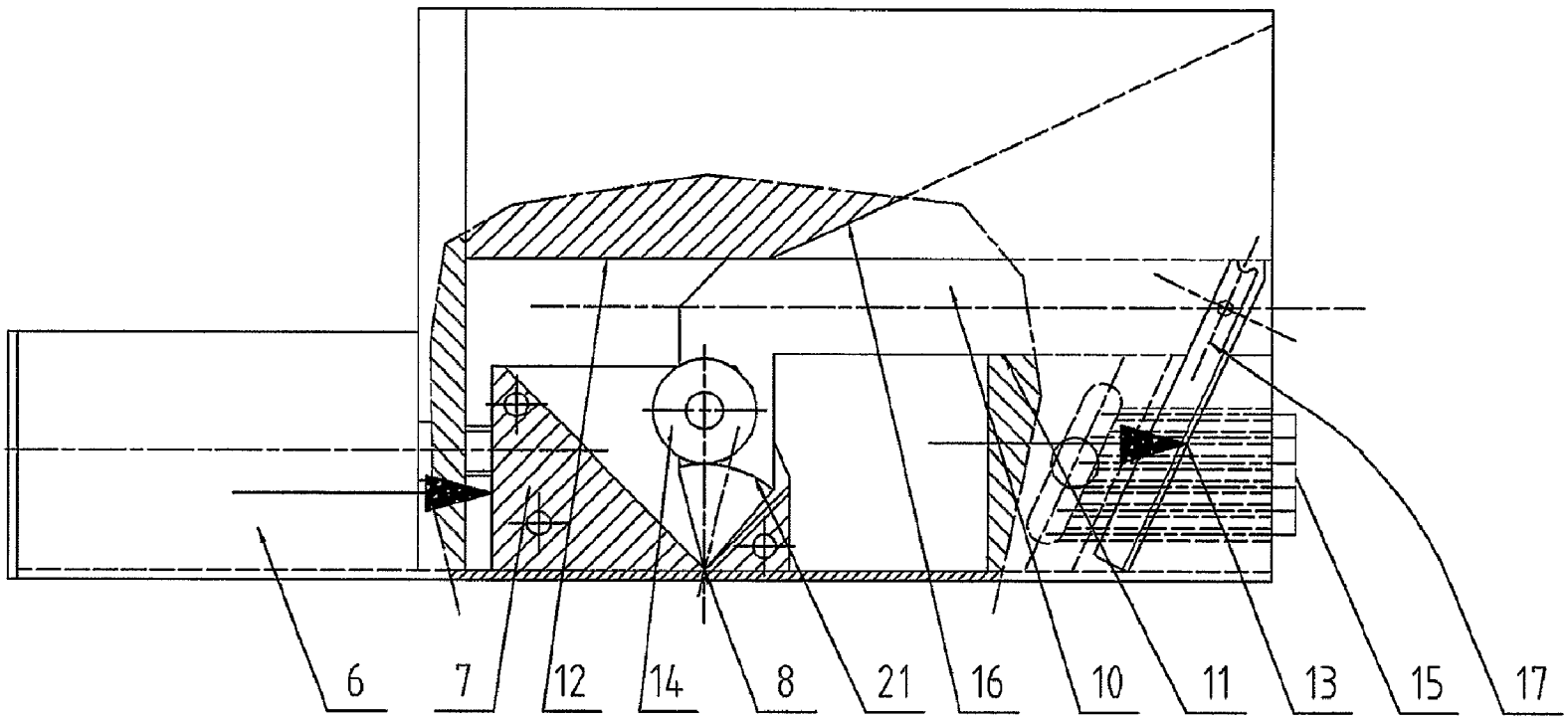
FIG. 3 shows a side view in detail having a partial section of the blank separator during the starting moment, from the home position, according to the invention.
Figure 4:
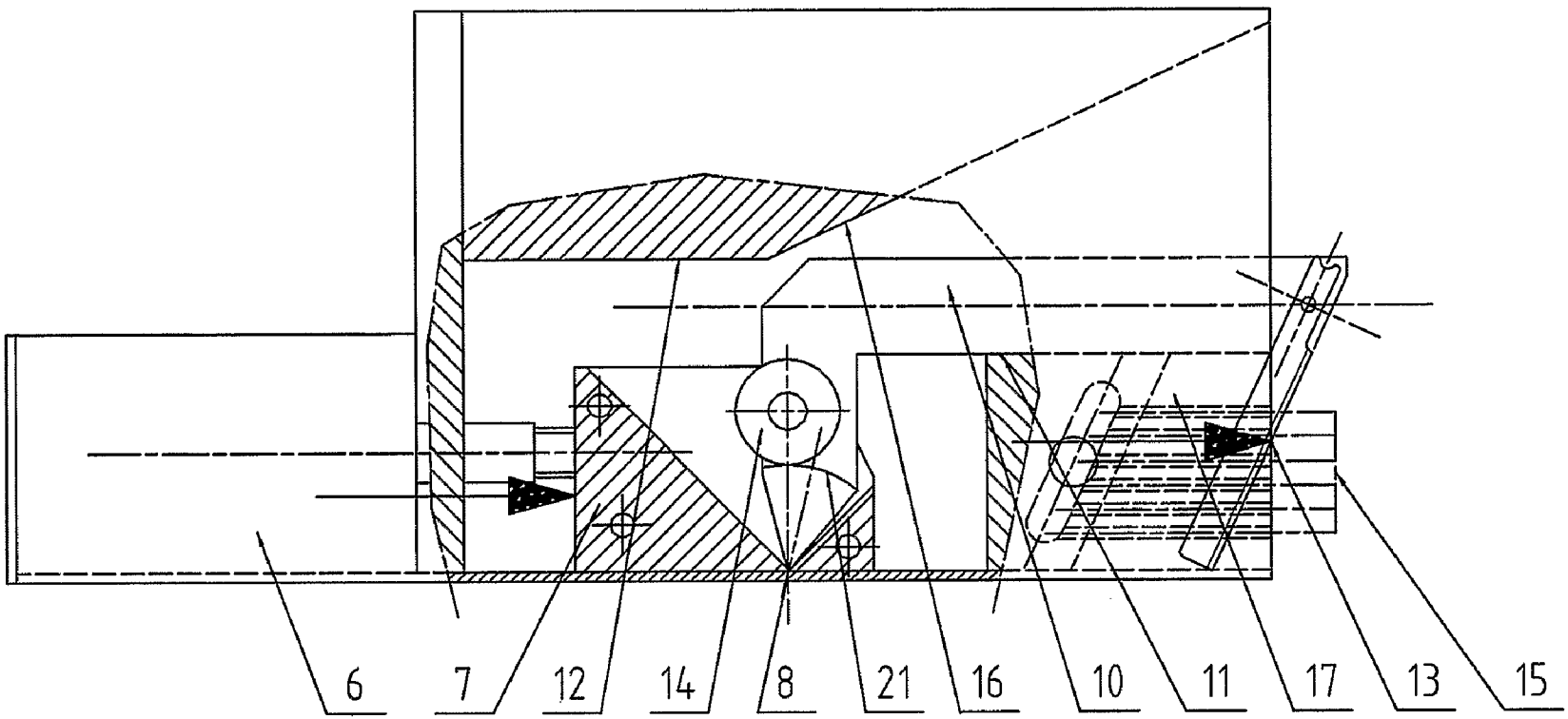
FIG. 4 shows a side view in detail having a partial section of the blank separator during the grasping phase.
Figure 5:
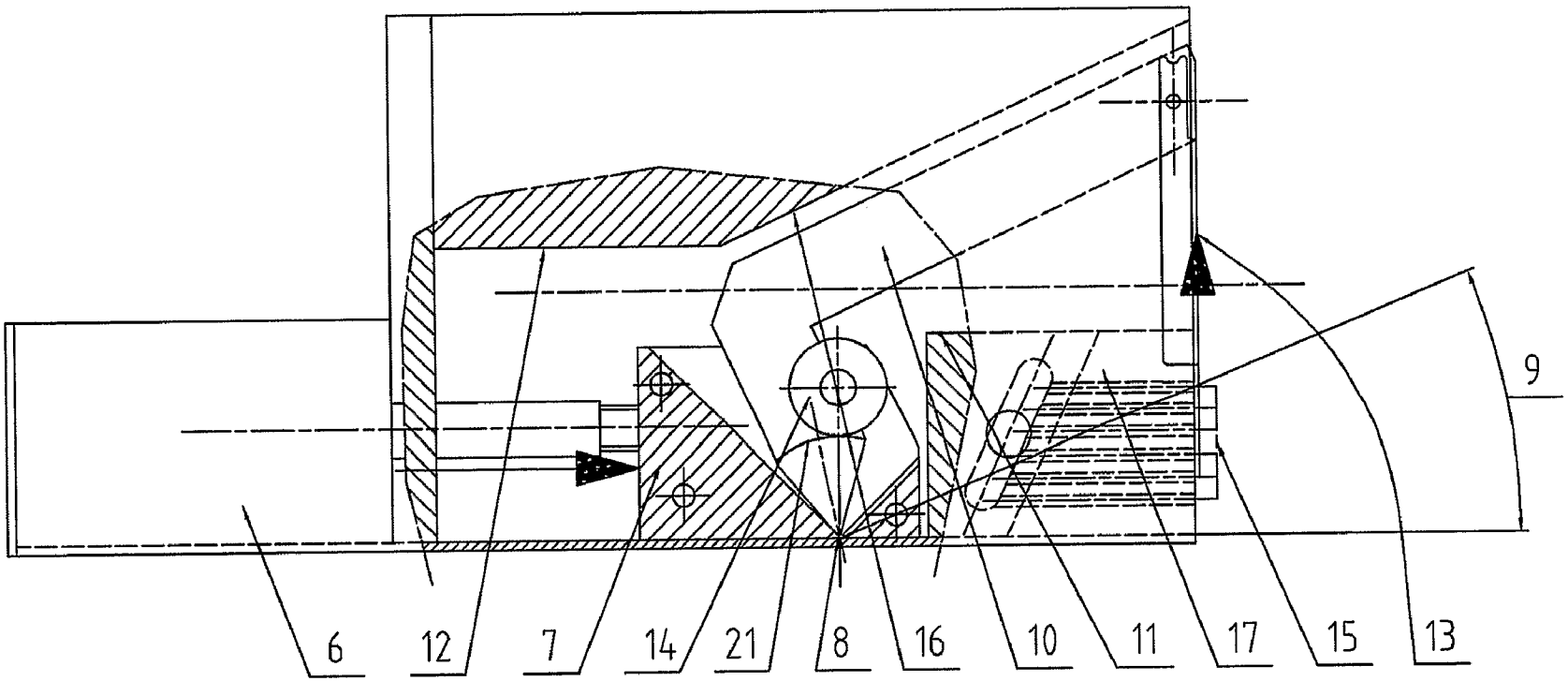
FIG. 5 shows a side view in detail having a partial section of the blank separator during the end of the separating phase.
Figure 6:
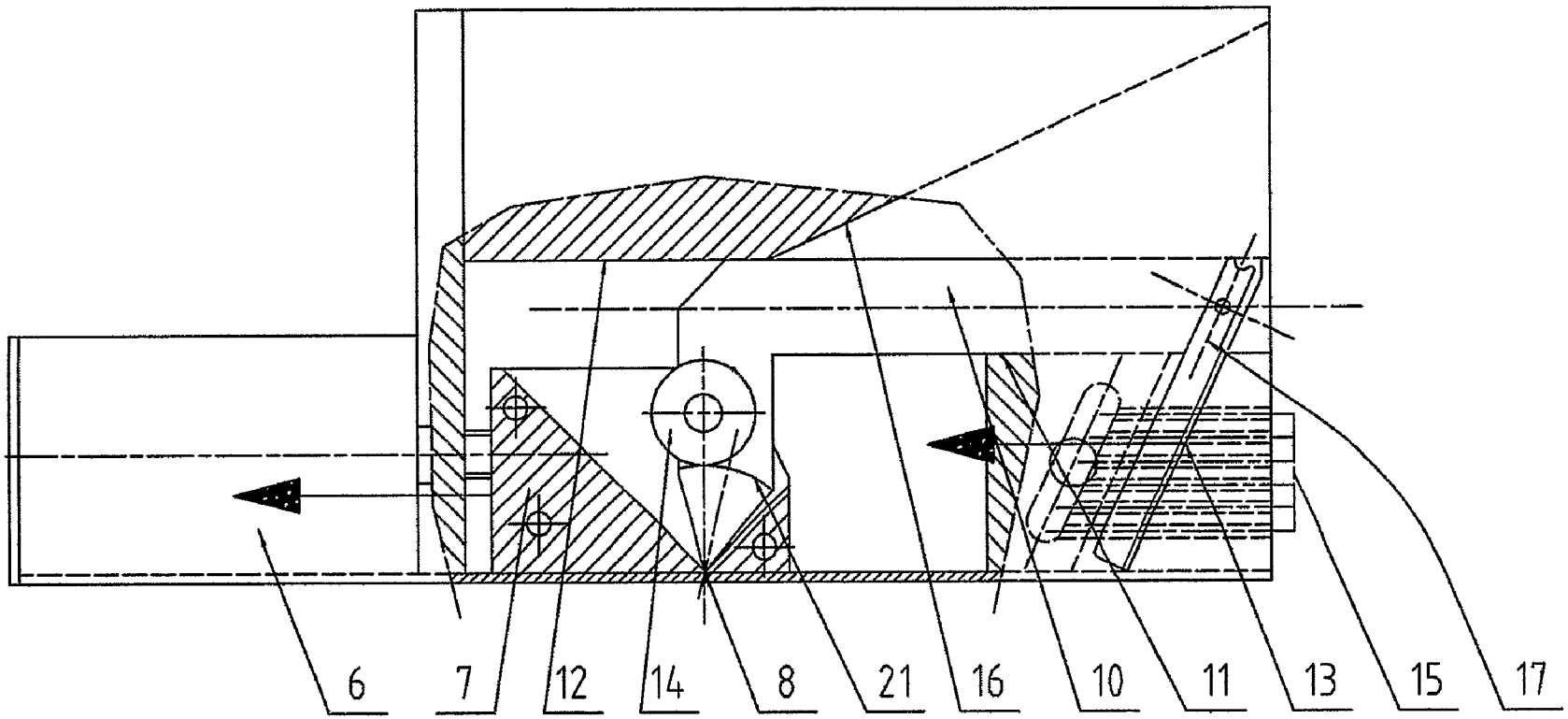
FIG. 6 shows a side view in detail having a partial section of the blank separator during the stopping moment of the return to the home position.
Figure 7:
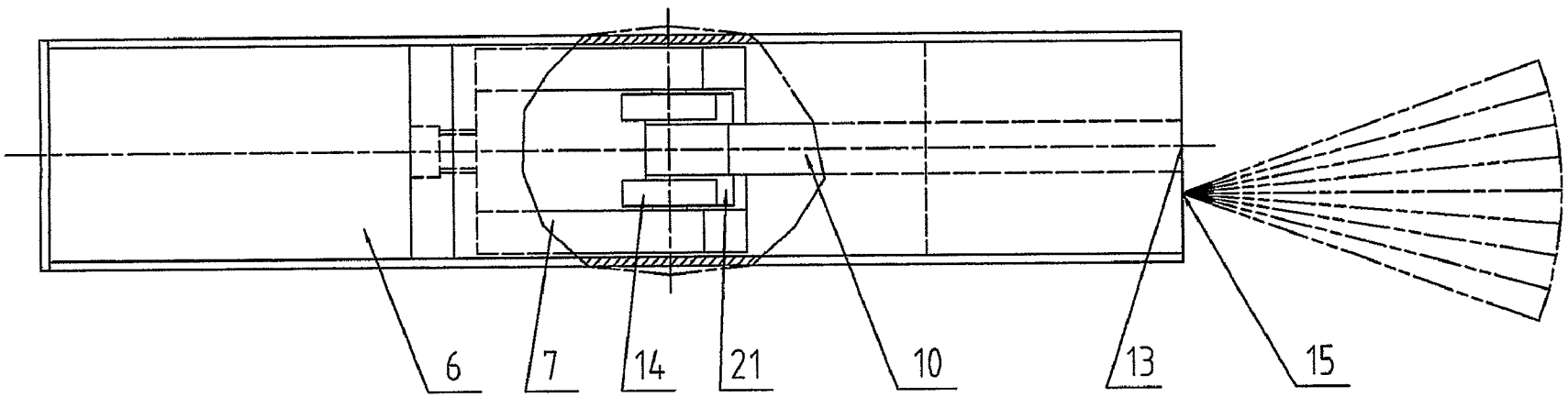
FIG. 7 shows a view from above having a partial section of the blank separator.
Figure 8:
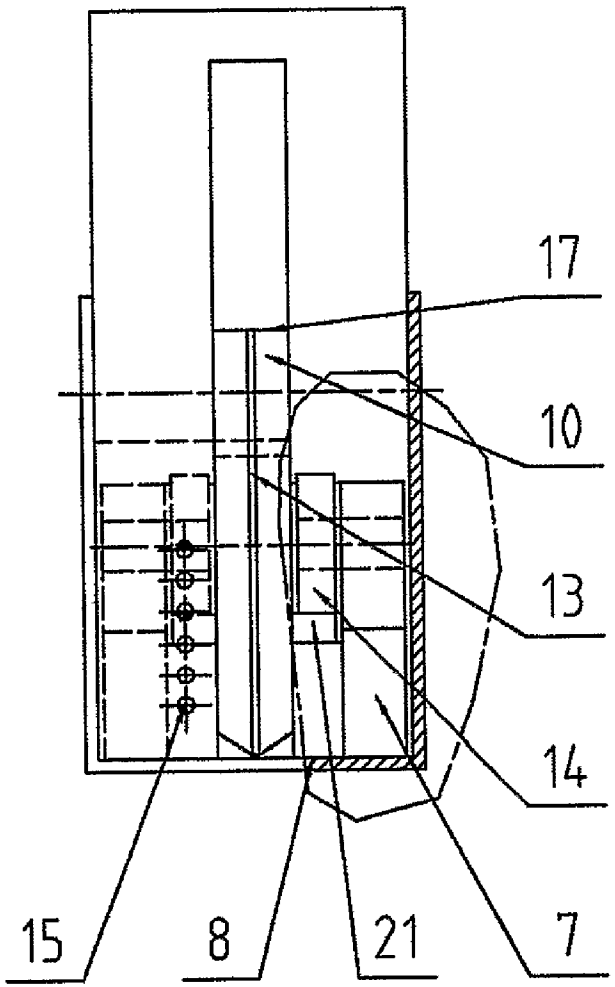
FIG. 8 shows an end view having a partial section, viewed from the blank stack of the blank separator.

FIG. 8 shows an end view illustrated from the blank stack. From this is evident that the free end or edge of a separating arm 10 comprises at least one friction surface and which in the example illustrated consists of a narrow blade 13 provided with teeth or point projections, the blade having a thickness of approximately 1 mm, said blade by aid of its sharp teeth can grasp the upper blank of the stack 2. Here is also illustrated the separating min 10 in its protected home position 17 (see also FIG. 3) and a curve 21 provided on the separating arm 10, which abuts against a bearing 14, so that the distance to its theoretical bearing point 8 in a slide 7 always in constant. In the view according to FIG. 8 also those openings, which via an unique channel system causes an air beam 15, which quickly eliminates the vacuum between the two upper blanks and gives the upper most separated blank a lifting force.

FIGS. 3-6 describe a working cycle for a separating unit 1 according to the invention. A driving unit 6 has as a task to drive a controlled slide 7 in a movement forwards and backwards and which slide 7 has a theoretic bearing point 8 peculiar for the invention. Said curve 21 on the separating arm 10 has its theoretical bearing point 8 and its own axis center placed outside the body of the separating unit 1 or at the most 5 mm inwards from the underside of the body of the separating unit 1. One feature for the theoretical bearing point 8 of this curve 21 is that it has an angle 9, which is between 0 and 90° to the horizontal plane or the extension plane for the uppermost blank of the blank stack. The separating arm 10 is driven in this bearing point 8 by aid of said slide 7 together with its blade 13 firmly provided in its free end in a predetermined angle in a oscillation for the separation of blanks by aid of said blade 13. The separating arm 10 with its blade 13 is kept down against the bearing point 8 in that the separating arm 10 comprises in it back, lower end, said curve 21, which supports against the bearing 14 mounted in the slide 7. The separating arm 10 is, in the example illustrated, also guided by slide surfaces 11 and 12, so that it first is displaced horizontally until the narrow blade 13 is leaving its home position, said blade 13 is mounted on the separating arm 10 and is provided with teeth and pointed projections, which Is typical for the invention and is loosen from the upper slide surface 12 and by one of its sharp teeth grasp the uppermost blank of the stack 2. An upwards directed force is now also constituted in relation to the size of the sinus on the angle 9, which also is secant on the angle 9, which is the inverted value of cos of the angle 9 i.e. the quotient of the hypotenuse and the closely allied cathetus on the created triangle.

$$\sec A = \frac{c}{b} \quad \sin A = \frac{a}{c}$$

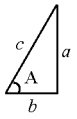

sec A = Secant on the angle 9
$c$ = Hypotenuse
$b$ = Closely allied cathetus
$a$ = Opposite cathetus In this position the separating arm 10 is free from the upper slide surface 12 but guided on the curve 21 by the bearing 14 and via the bearing point 8 influenced by the driving unit 6 in one in this position driving force directed forwards. This force-tregometric relation between the different force-composites provides a further feature for the invention, namely, that the gripping arm in the tooth provided narrow blade 13 distinctly is gripping in within a position in the area between the upper and the next upper blank 3 of the stack 2 or immediate below with different and with one after each condition adapted force in relation to which lifting force needed to separate and lift up the uppermost blank of the blank stack. When the separating arm 10 shall start its lifting movement the function air beam 15 or not can have been chosen, which determines if an air beam 1 shall be used or not in order to quicker eliminate the vacuum between the two upper blanks. Independent of if the function air beam 15 has been chosen or not, the separating arm 10 being moved, now guided by the bearing point 8 and the bearing 14 pressing against the curve 21 and the above mentioned force-tregometric relation created by the angle 9, between the different force-composites in a direction to a plane 16 at the same time as the teeth provided, narrow blade 13 is keeping its grasp in the blank edge on the uppermost blank of the stack, which at this moment is separated from the underlying blank and because of that also joins the way upwards. In this leaving position the blank is separated and is handed over to any type of picking up means 4 for feeding into a subsequent machine, so that also the function air beam 15 is shut off if it has been used during the separation. When the teeth provided, narrow blade 13 has left over the blank to the picking up means 4 the driving unit 6 its returning movement and pull back the force guided slide 7, which via the bearing point 8 pulls the separating arm 10 backwards, so that the upper slide surface 12 is letting the separating arm 10 down and thereafter returns to the home position 17.

Figure 9:
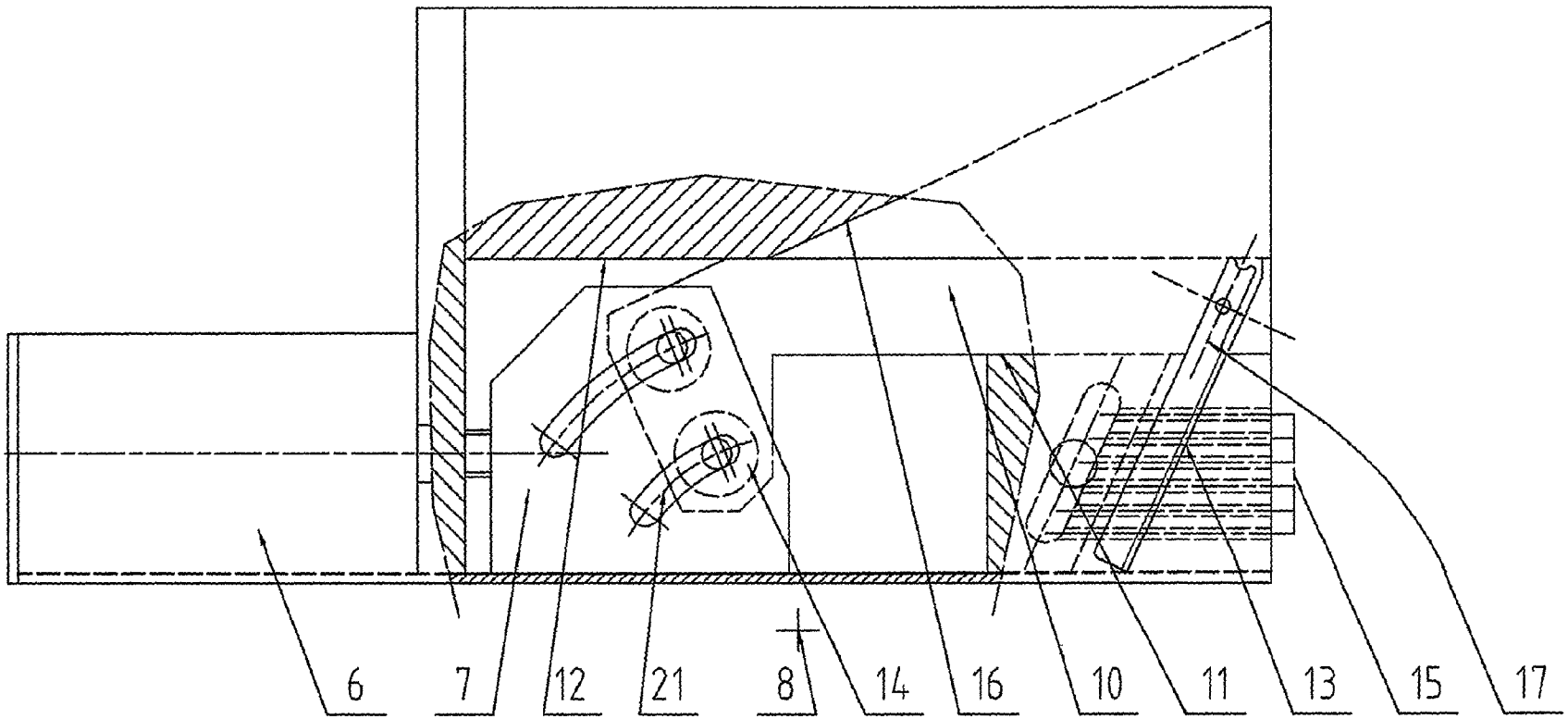
FIG. 9 shows a side view in detail having a partial section of the blank separator where the separating arm is guided by through pins in milled curves in the sides of the slide.
Figure 10:
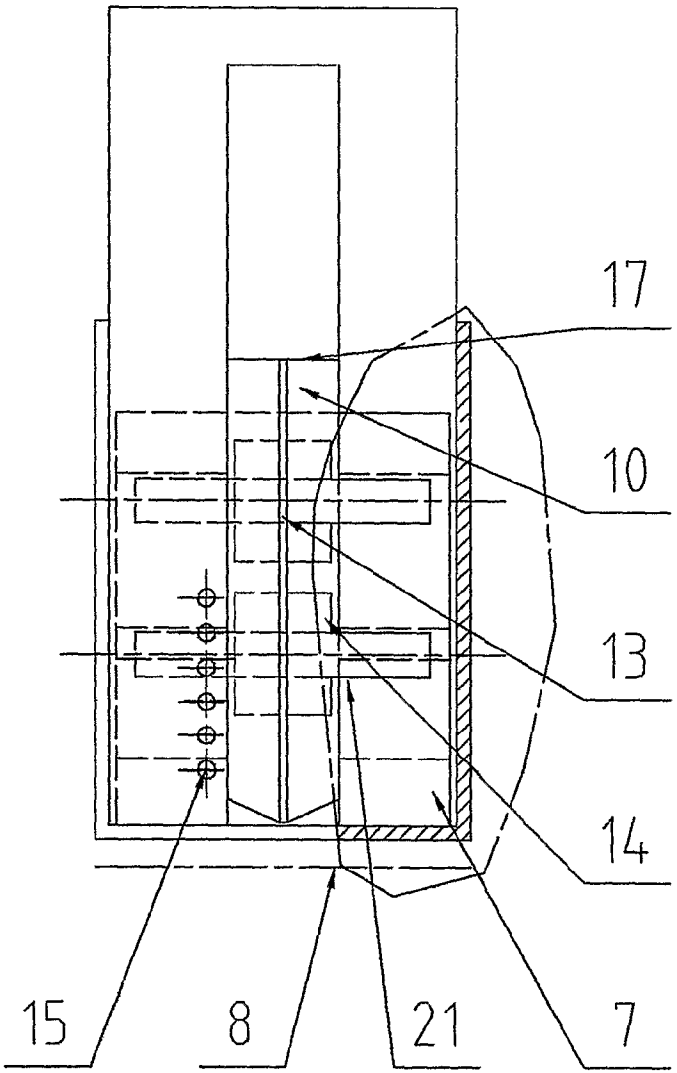
FIG. 10 shows an end view of FIG. 9 having a partial section, viewed from the blank stack of the blank separator.

In FIGS. 9 and 10 examples are illustrated of another type of curve 21, which gives similar movement pattern for the separating arm 10 and its blade 13. Here double bearings 14 are instead used in the separating arm 10 having through running pins, which thereafter are guiding in milled curves 21 in the form of curve grooves in the sides of the slide 7.

What is claimed is:

1. A method for continuous piece by piece separation of magnetic and non-magnetic mainly plane sheet or disc-shaped blanks, such as plates of steel, aluminum, plastic sheets and the like, which are piled up in a stack by aid of at least one separating unit, the method comprising:

actuating a slide displaceable in the separating unit, the actuating being performed by a driving unit, which in turn actuates a separating arm having at least one friction surface in its front, free end and which hereby is pushed out from said separating unit in a movement direction, which is mainly 90° to a side plane of said stack in both directions, wherein the separating arm is guided in the slide by a curve of the separating arm, and when said friction surface, forming an angle to the side plane of the stack, is contacting a blank, turning the separating arm in the slide a predetermined angle at the same time as the first point on the friction surface has reached the blank stack such that formation of the angle allows the friction surface to only contact an uppermost blank of the stack, the friction from the friction surface of the separating arm gripping the uppermost blank when that point of the friction surface, which has contacted the blank, changes its movement direction in order thereafter to follow that movement direction which is mainly in parallel to the side plane of the stack and which is also the separating direction of the blank in separating the upper most blank of the stack from underlying blanks.

2. A device for carrying out a method for continuous piece by piece separation of magnetic and non-magnetic mainly plane sheet or disc-shaped blanks, such as plates of steel, aluminum, plastic sheets and the like, which are piled up in a stack by aid of a at least one separating unit, wherein the separating unit comprises:

a slide displaceable by a driving unit in a movement forwards and backwards, which in turn actuates a separating arm, which in its front, free, outer end is provided with an angled blade having one or several friction surfaces and which separating arm is guided in said slide via a curve provided in the separation arm and protrudes from the separating unit in a movement direction, which is mainly 90° to a side plane of the blank stack in both directions in separating a blank from the blank stack.

3. A device according to claim 2, wherein the friction surface or surfaces of the separating arm include narrow, toothed or point provided saw blades or saw blade shaped projections formed on an angled blade fixed to the free end of the arm, said blade is provided to distinctly catch by aid of one of its sharp teeth into a point in the area between the upper most and a next upper most blank of the stack or directly under.

4. A device according to claim 3, wherein the blade, which is provided to catch the blank, is narrow, having a thickness sufficiently thin to reach in sharp corners and separate strongly formed cut blanks.

5. A device according to claim 2, wherein the movement of the separating arm is guided in the slide via the curve which is provided on the end portion of the arm at the same time as said arm is kept down against a bearing point in the slide by aid of a bearing mounted in the slide, against which the curve supports.

6. A device according to claim 2, wherein the movement of the separating arm is guided in said slide via the curve which is in the form of curve grooves in its sides by aid of bearings provided in the end portion of the separating arm, said bearings having through pins, guided in said curve grooves.

7. A device according to claim 5, wherein the curve includes a theoretical bearing point and its own axes center placed outside both its own body and the one of the separating unit, which makes a separating of blanks downwards to the corresponding level possible.

8. A device according to claim 7, wherein the stack is step by step adjustable upwards in relation to the separating unit or that the separating unit is step by step adjustable downwards in relation to the blank stack in order to obtain an optimal accommodation afterwards as the stack is used, until the separating unit meets the support, on which the stack is placed, whereby in this bottom position, the separating unit continues to separate blanks downwards to the theoretical bearing point or support.

9. A device according to claim 3, wherein a trigonometric relation between different force components provides that the gripping tooth in the blade applies a force adapted automatically to be sufficient to separate and lift up the uppermost blank of the blank stack.

10. A device according to claim 3, wherein the combination of the saw blade formed friction surface and air provided by an air beam inserted between the blanks is used to hasten the break apart of the adhering forces between the blanks and to eliminate eventual vacuum between the two uppermost blanks in speeding up the separation by giving the uppermost blank a lifting force of that air cushion, which in this case is achieved between the blanks.

11. A device according to claim 4, wherein the blade has a thickness of substantially one millimeter.

12. A device according to claim 5, wherein the curve includes a theoretical bearing point and its own axes center placed no less than 5 mm inwards from a lower side of the body of the separating unit, which makes separating of blanks downwards to the corresponding level possible.

* * * * *